US005285430A

United States Patent [19]

Decker

[11] Patent Number: 5,285,430

[45] Date of Patent: Feb. 8, 1994

[54] BEHAVIOR MODIFICATION WRISTWATCH

[76] Inventor: Neil W. Decker, 3635 N. Eagle Rd., Eagle, Id. 83616

[21] Appl. No.: 997,206

[22] Filed: Dec. 28, 1992

[51] Int. Cl.[5] ..... G04B 45/00

[52] U.S. Cl. ..... 368/281; 368/282; 368/223; 368/228

[58] Field of Search ..... 368/281-282, 368/223-239

[56] References Cited

U.S. PATENT DOCUMENTS

| | | | |
|---|---|---|---|
| 1,509,855 | 9/1924 | Wadsworth et al. | 368/281 |
| 1,516,223 | 8/1923 | Wadsworth | 368/281 |
| 4,630,935 | 12/1986 | Zettek | 368/41 |
| 4,853,854 | 8/1989 | Behar et al. | 364/413.01 |

*Primary Examiner*—Bernard Roskoski
*Attorney, Agent, or Firm*—Frank J. Dykas; Craig M. Korfanta; Ken J. Pedersen

[57] ABSTRACT

A behavior modification wristwatch (10) is disclosed which has a watch body (11) shaped in the form of an octagon, includes a face which is red in color and has the word "stop" printed on it to resemble a stop sign and thereby serve as a constant conscious and subconscious reminder to the user to stop his or her destructive behavior. Watch (10) includes three digital displays, a watch display (16) for displaying normal watch functions such as the time of day, the date, day of the week, alarm time, etc., a count-up display (17) for displaying elapsed time in days, hours and minutes for counting the time since the individual quit the destructive behavior, and a multi-character alpha display (18) for displaying words or phrases of positive reinforcement after certain elapsed periods of time. Watch (10) also includes an audible alarm (34) for generating an audible signal responsive to both the set alarm time and the transition of the positive reinforcement display (18) from one phrase to another to draw the user's attention to watch (10) and facilitate the user experiencing a sense of accomplishment.

3 Claims, 5 Drawing Sheets

15
14
11
12
15

15
26
18
17
16
13
15
14
11
12

15
26
11
13
15

15
14
26
12
13
15

BEHAVIOR MODIFICATION WRISTWATCH

BACKGROUND OF THE INVENTION

1. Technical Field

This invention generally relates to wristwatches, but more particularly, this invention relates to a wristwatch which also serves as a behavior modification aid to encourage its user to refrain from a particular behavior.

2. Background Art

Since the beginning of recorded history people have been plagued with both physically destructive behavior patterns and emotional or morally destructive behavior patterns. Destructive physical habits include alcoholism, drug addiction, tobacco addiction, physical abuse, overeating and laziness. Destructive emotional or moral behaviors, while largely dependent upon an individual's personal convictions, might include gambling, swearing, discrimination, emotional abuse and certain sexual behavior.

For almost as long as these destructive behaviors have been around, people have tried various methods to modify them. Diet programs, chemical dependency programs, stop-smoking programs, counseling services and other behavioral modification devices have become very popular in the latter quarter of the twentieth century. The success of any one program or device is almost entirely dependent upon the individual's desire to quit the destructive behavior and the individual's susceptibility to the program or device stimulus.

Even though a particular person has a relatively strong desire to stop a destructive behavior, he or she might not react well to the program or device stimulus. This can actually be counter productive. Different people react to different stimulus. Some of the more successful programs or devices take advantage of peoples' non-destructive habits to continually reinforce abstinence from the destructive behavior. One of the more common methods which does this involves posting affirmations in a conspicuous place such as on the bathroom mirror. This takes advantage of the daily ritual of standing in front of the mirror while brushing one's teeth, shaving, or combing one's hair to reinforce the messages expressed in the affirmations. Unfortunately, this reinforcement may only occur a single time per day. Increasing the frequency of these affirmations often results in posting affirmation lists throughout one's home, automobile and work place, unfortunately for all to see.

What is needed is an unobtrusive method of frequent positive reinforcement to help individuals to abstain from particular behaviors.

DISCLOSURE OF INVENTION

This need, as well as others, is satisfied by a wristwatch which is configured to provide positive mental motivation to the user through constant visual reinforcement. The watch takes advantage of the frequency of which one views their watch throughout the day to provide an "object lesson" every time that person views their watch.

The wristwatch is shaped in the form of an octagon, is red in color and has the word "stop" printed across the face of the watch. The watch is configured to resemble a stop sign to serve as a constant conscious and subconscious reminder to the user to stop their destructive behavior. The watch includes three digital displays, one for displaying normal watch functions such as the time of day, date, day of the week, alarm time, etc., one for displaying elapsed time in days, hours and minutes for counting the time since the individual quit the particular destructive behavior, and one display for displaying words or phrases of positive reinforcement after certain elapsed periods of time. The watch includes an alarm for generating an audible signal responsive to both the set alarm time and to the transition of the positive reinforcement display from one positive reinforcement phrase to another to draw the user's attention to the watch and facilitate the user experiencing a sense of accomplishment. Once the user decides to quit a particular behavior, he or she activates the count-up timer. If he or she ever starts the behavior again, then he or she must reset the timer and start over again.

BEST MODE FOR CARRYING OUT INVENTION

Figure 1:
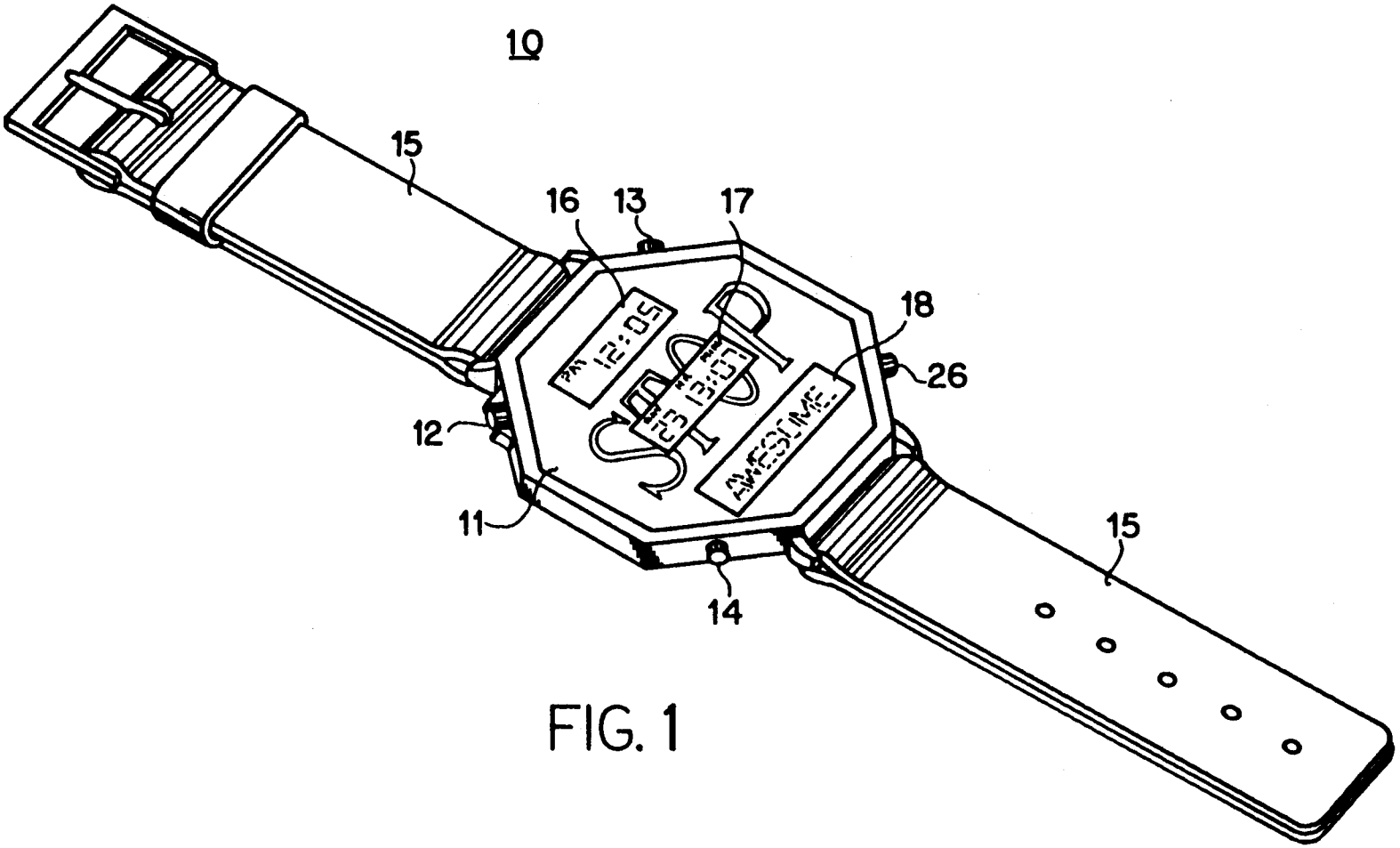
FIG. 1 is a three quarter view of a first design of the behavior modification wristwatch.
Figures 2, 3, 4, 5:
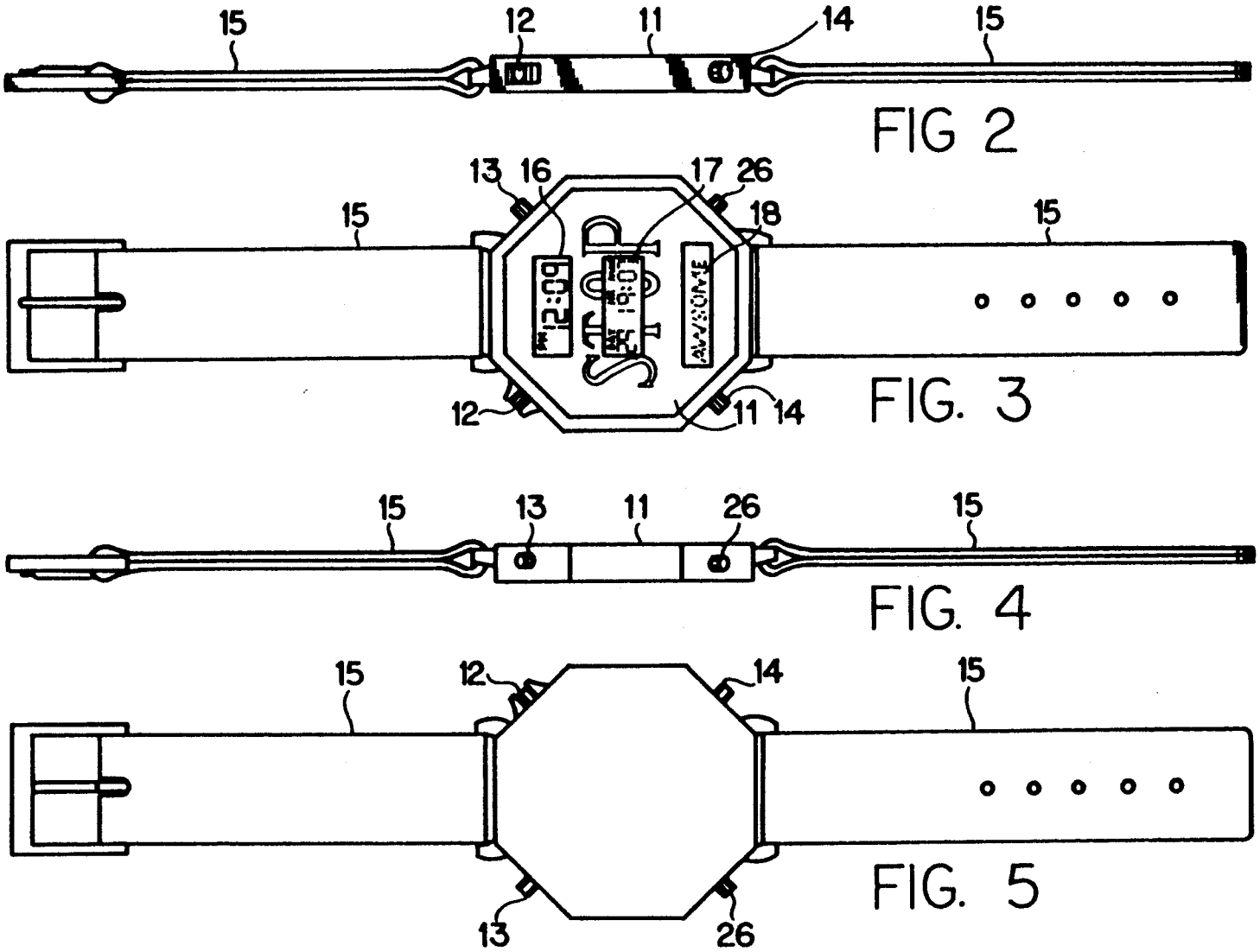
FIG. 2 is a left side view of the first design.
FIG. 3 is a top view of the first design.
FIG. 4 is a right side view of the first design.
FIG. 5 is a bottom view of the first design.
Figure 6:
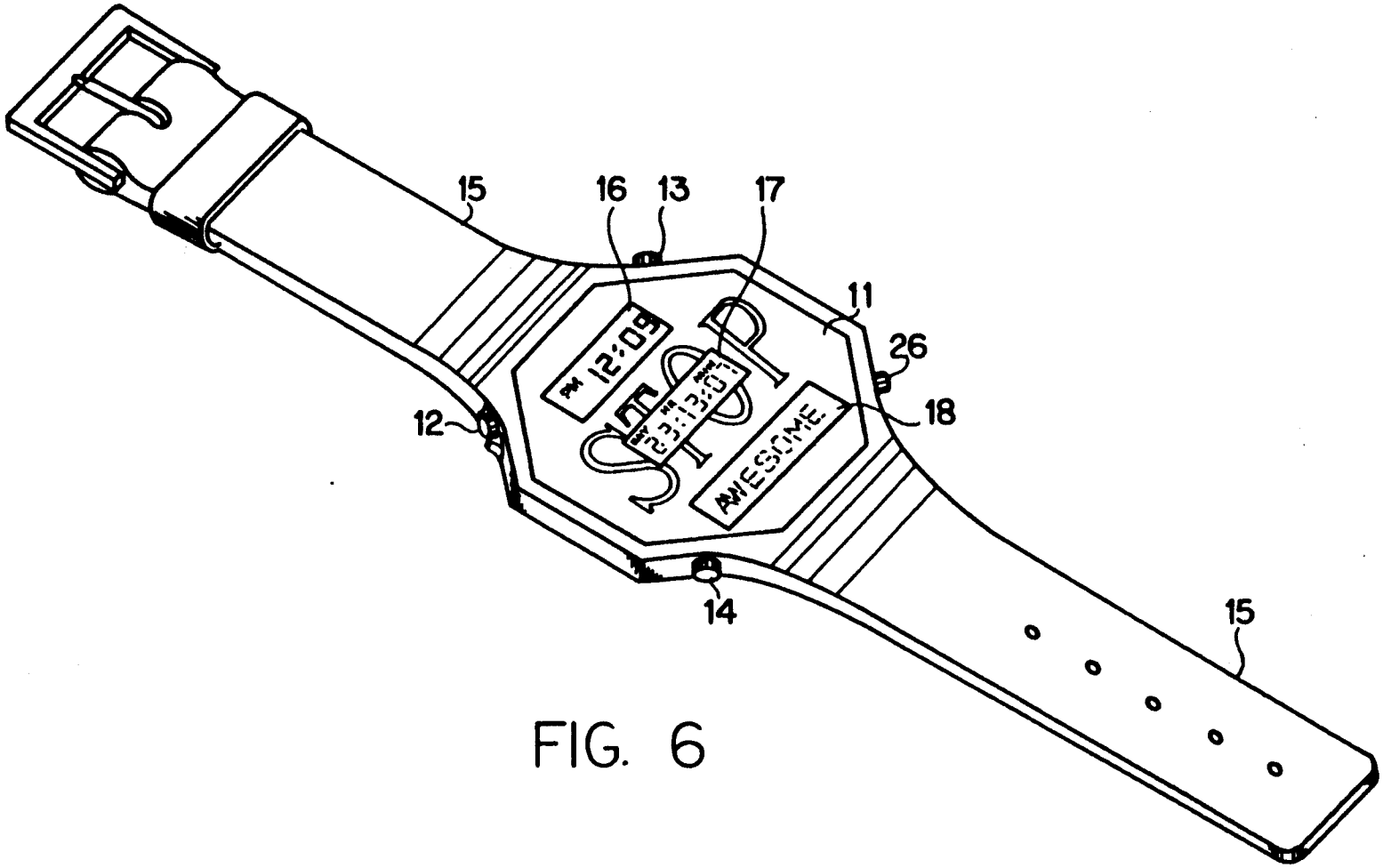
FIG. 6 is a three quarter view of a second design of the behavior modification wristwatch.
Figure 7:
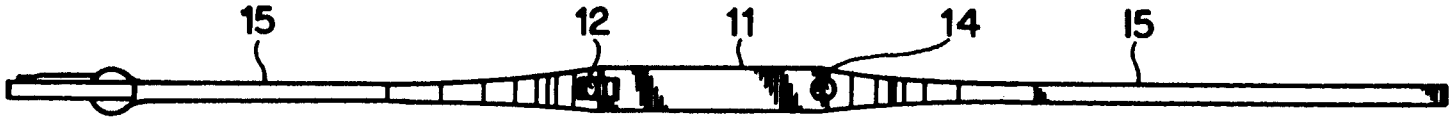
FIG. 7 is a left side view of the second design.
Figure 8:
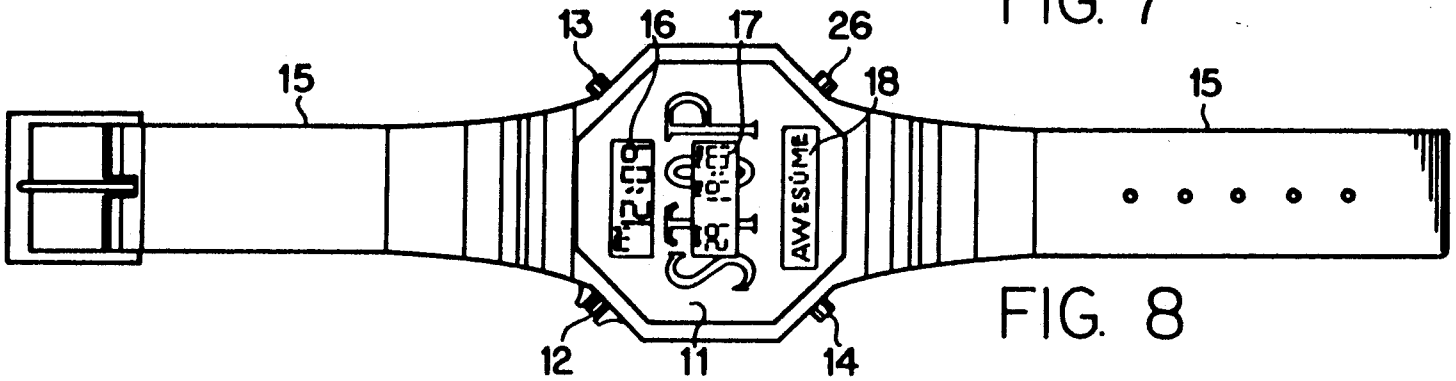
FIG. 8 is a top view of the second design.
Figure 9:
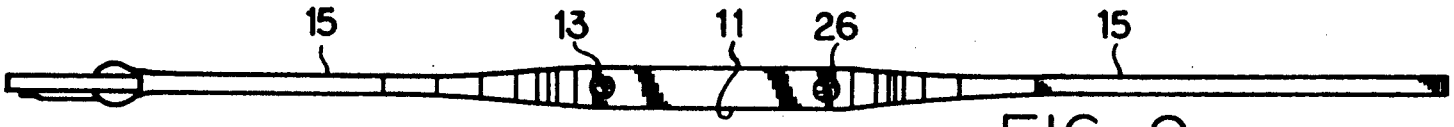
FIG. 9 is a right side view of the second design.
Figure 10:
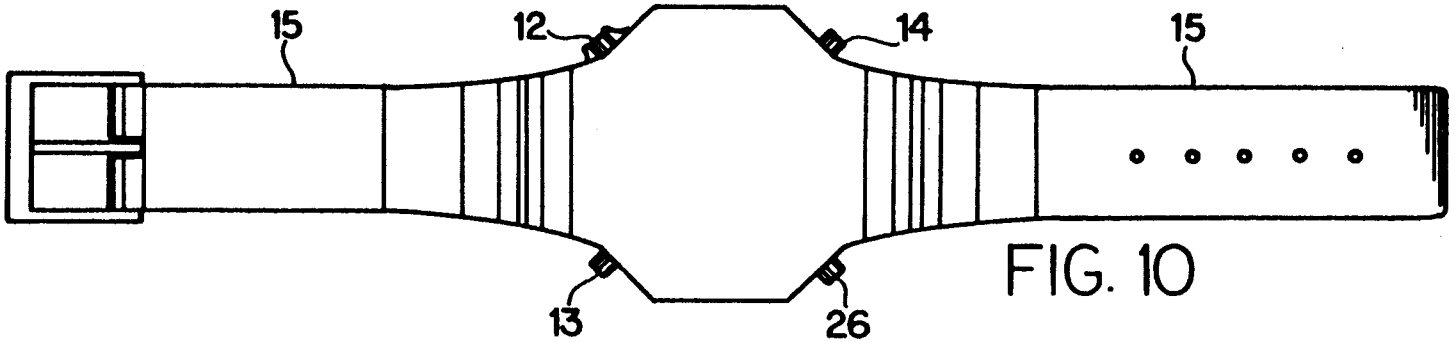
FIG. 10 is a bottom view of the second design.
Figure 11:
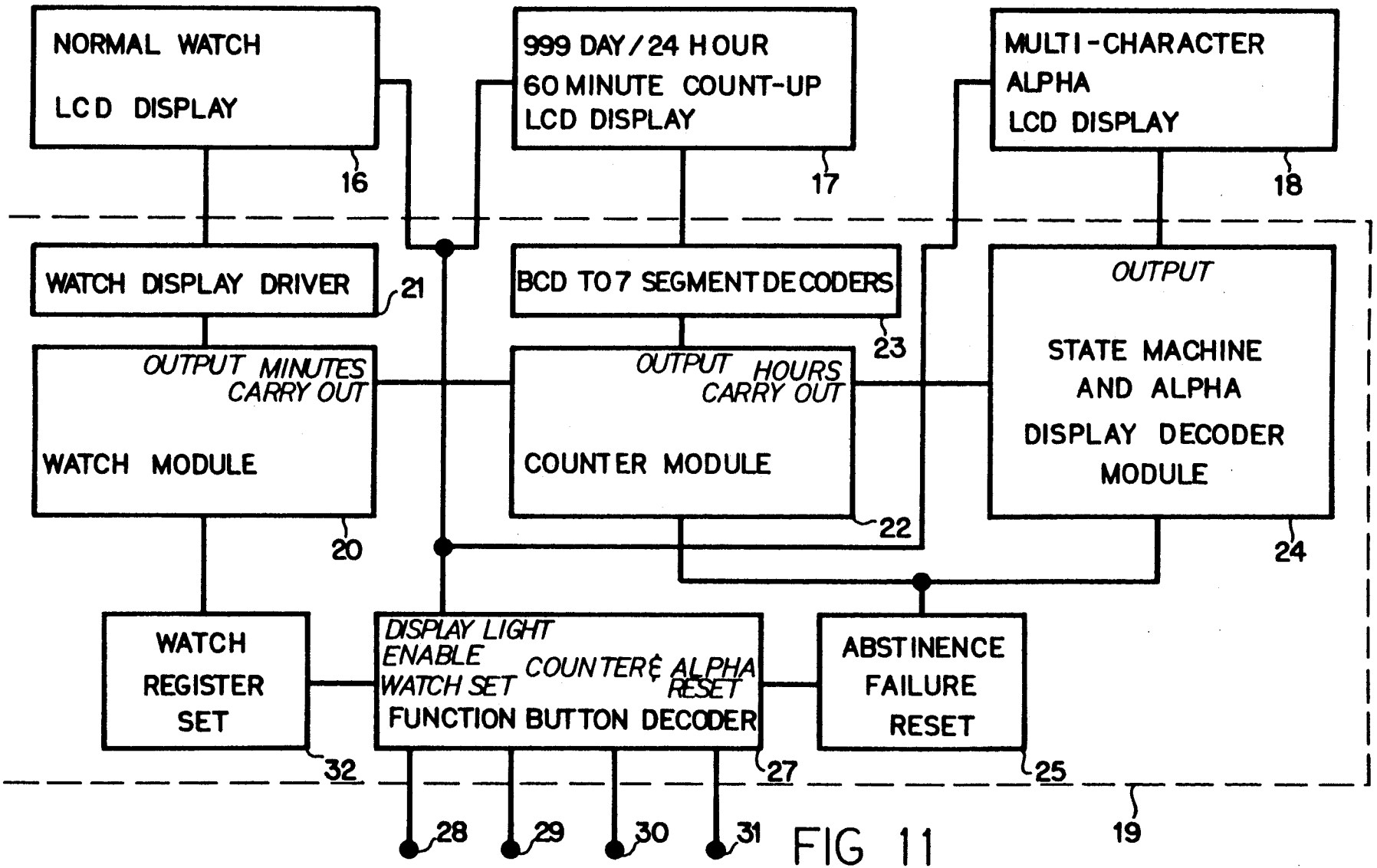
FIG. 11 is a representational block circuit diagram for a CMOS VLSI implementation for the behavior modification wristwatch.

Referring now to the figures, two physical designs for the behavior modification wristwatch 10 are illustrated, one possible dress version shown in FIGS. 1 through 4 and one possible sport version shown in FIGS. 5 through 8. FIG. 9 illustrates, in block diagram form, a VLSI monolithic integrated circuit (IC) design to provide the electronic functions to either of the two designs shown.

Regardless of the exact design, behavior modification wristwatch 10 at least includes an octagon-shaped watch body 11 configured to resemble a stop sign, a watch band 15, a watch display 16 for at least displaying the time of day, a count-up timer display 17 for displaying elapsed time in terms of hours and days, and an internal electronic circuit for generating the time signals for both the time display 16 and the count-up display 17. A third display, multi-character alpha display 18, is also desirable and serves to display positive words of reinforcement in response to pre-set elapsed time intervals. Preferably four function set buttons, set mode button 12, watch mode button 13, display light button 26 and abstinence start/reset button 14, are provided to allow the user to set and reset the various watch functions.

This preferred embodiment contemplates a monolithic CMOS VLSI IC implementation for the main electronic circuit 19. IC 19 includes as its primary components a watch module 20, a counter module 22, a state machine and alpha display decoder module 24 and a function button decoder module 27. Supporting components of IC 19 include a watch display driver 21, BCD to seven segment decoders 23, watch register set module 32, alarm signal generator 33 and abstinence failure reset module 25. Because actual gate level logic of IC 19 is ultimately dependent on both the particular watch functions implemented as well as the specific display types used, and the logic design is well within current state of the art, the explanation of IC 19 will be limited by the various functional aspects of each module and how they combine to form the invention.

The central module to IC 19 is watch module 20 which serves to keep track of the time of day, AM or PM, date and day of the week, as well as any alarm functions which may be implemented. Additionally, watch module 20 provides a carry out signal to counter module 22 for every minute of elapsed time. Watch module 20 includes internal time and date registers which are incremented in response to elapsed time and can be manually incremented by watch register set module 32 to set the time of day and the date. The output of watch module 20 is decoded by display driver module 21 which displays the time, date, etc., on watch display 16.

As can be seen in FIGS. 1, 3, 6 and 8, time and date watch display 16 includes two seven-segment display digits for displaying the number of minutes, and, a seven-segment display digit and a two-segment display digit for displaying the number of hours. These display digits can also serve to display the date. Alternatively, a separate set of digits can be provided. Normally, the hours and minutes are separated by a flashing colon, while the month and day are separated by a dash. Alpha digits can also be added to display the current day of the week, usually a two character abbreviation is sufficient. Watch display driver 21 is further configured to blink any particular portion of the display representing the contents of a register which is currently being set by watch register set module 32 in order to notify the user as to what information he or she is updating.

Watch register set module 32 is responsive to the watch set enable output, the register select output and the register advance output of function button decoder module 27. The logic of function button decoder 27 is configured to alter the functions of buttons 13 and 14, possibly even button 26, dependent upon the state of set mode button 12. Function buttons 12, 13, 14 and 26 are connected to inputs 28, 29, 30 and 31 respectively, of function button decoder 27 to provide a means for user input to vary the functions of the watch. For example, if set mode button 12 has been depressed a single time, button 13 might serve to cycle through the individual watch registers while button 14 would serve to advance the value of the selected register, the contents of which would continuously blink on watch display 16 while that particular register was selected. A second depression of button 12 would take the watch out of the set mode and place it in an normal operating mode. In this mode, button 13 serves to cycle watch display 16 through its various display such as the time, day, date or alarm time, while button 14 serves to start, stop and reset display 18. Resetting display 18 clears the count-up register in count-up module 22 and resets state machine 24 to its zero state.

Additionally, function button decoder 27 has a display light enable output, a counter reset output and an alpha reset output. The display light enable output simply activates the illumination means for displays 16, 17 and 18 in response to a depression of button 26. The counter and alpha reset output enables abstinence failure reset module 25 in response to a quick double depression of abstinence start/reset button 14. Abstinence failure reset module 25 then resets counter module 22 to zero and resets state machine 24 to its zero state. A double depression on button 14 is used as an interlock to make sure that abstinence failure reset 25 isn't triggered accidentally, thereby losing the measure of accomplishment for the user.

Counter module 22 includes three internal registers, one corresponding to the elapsed number of minutes, one to the elapsed number of hours and one to the elapsed number of days. The minutes register receives input from the minutes carry-out output of watch module 20. The elapsed minutes accumulate in the minutes register until the total value exceeds fifty-nine. The sixtieth minute results in the minutes register being reset and an hours carry signal being sent to the internal hours register, as well as to the trigger input on state machine and alpha decoder module 24. The hours carry signal updates the internal hours register. Successive elapsed hours accumulate in the hours register until the total value exceeds twenty-three. The twenty-fourth hour results in the internal hours register being reset and a day carry signal being sent to the internal elapsed days register which accumulates elapsed days through nine-hundred-ninety-nine before all three internal registers are reset.

The output of the counter module is decoded by BCD to seven segment decoders 23. Decoders 23 drive count-up timer display 17. Here, count-up timer display 17 has seven LCD digits, each consisting of a seven-segment display. The three left most and two right most digits are separated from the middle two digits by colons, the two right most digits representing elapsed minutes, the two middle digits representing elapsed hours, and the remaining three digits representing elapsed days. Display 17 includes a background light which is responsive to the display light enable output of function button decoder 27.

The exact logic of state machine and alpha character display decoder module 24 is largely dependent upon the particular type of multi-character display 18. A fairly minimal implementation would include eight sixteen-segment LCD character displays which translates into one-hundred and twenty-eight outputs for state machine and alpha decoder module 24. It should be apparent that either a larger or a smaller number of segments could be used, as well as using 5×7 dot matrix arrays for each character. An eight character 5×7 dot matrix display would require two-hundred and eighty outputs for decoder 24, but it could allow the display of low-resolution graphics, scrolling of text, etc. The concept of text scrolling is especially interesting, since a text string of greater than the number of character arrays within the display could be scrolled across the display. However, additional columns would be required between the individual arrays to allow a smooth flow of the characters across the screen. Assuming a character spacing of two dots between characters, the number of outputs necessary on state machine and decoder module 24 rises to two-hundred and ninety-four and the logic of the decoder portion of the module becomes more complex, but it is still within the average level of skill in the art.

State machine and decoder module 24 is further configured to produce state transitions responsive to the value in the hours register in counter module 22, with each state transition corresponding to a word or phrase representing a progressively higher level of accomplishment. The hours carry out of counter module 22 provides a trigger for state machine and alpha decoder module 24. Each time an hours carry out signal is generated by counter module 22, the state machine will "check" to see if the display needs to be updated by comparing the "state" value with the value in the elapsed hours register.

In this preferred embodiment the logic of state machine 24 is configured to produce more positive feedback in the early stages of the abstinence period and progressively less feedback as the abstinence period gets longer and longer. This can be accomplished in a number of different ways. One way is to provide two look-up tables in the state machine, one which represents predetermined elapsed time values, each corresponding to a successive state, and one which represents words or phrases of positive reinforcement, one word or phrase for each preset time in the first look-up table. This method requires the state machine to compare the value located in the elapsed hours register within counter module 22 with the values in the look-up table. If the elapsed hours value matches one of those in the first look-up table, the corresponding word or words of positive reinforcement are latched into the display decoder portion of module 24 and consequently displayed on display 18. The following state transition table is based on the function $Y=X^2$ where Y represents the resulting value in the look-up table and X represents the state transition number.

Transition Table for Function $Y = X^2$

| (Y) # of State Transition | (X) Elapsed Hours | Elapsed Days |
|---|---|---|
| 1 | 1 | .04 |
| 2 | 4 | .17 |
| 3 | 9 | .38 |
| 4 | 16 | .67 |
| 5 | 25 | 1.04 |
| 6 | 36 | 1.5 |
| 7 | 49 | 2.04 |
| 8 | 64 | 2.67 |
| 9 | 81 | 3.38 |
| 10 | 100 | 4.17 |

It should be noted that the aforementioned function is but one possible progressive implementation. More exacting psychological studies might demonstrate more advantageous reinforcement times. Additionally, both faster or slower progressive scales could be employed, as well as a linear form of reinforcement. One simply has to change the values in the look-up table to change the reinforcement times. Furthermore, it is possible to eliminate the first look-up table. One way this can be accomplished is to use a digital implementation of the progressive function, here $Y=X^2$, and accumulate the state transitions in a separate register. If the number of elapsed hours exceeds the value resulting from evaluating the function, then the state register is incremented, as is alpha display 18. Other implementations should be apparent to those skilled in the art.

The second look-up table contains binary numbers, each binary bit representing the states of the individual display segments or dots necessary to display the word or words which correspond to that particular state. When a particular state is selected, the individual bits of the binary number are latched in a display register which acts to display the word or words continuously until another state is selected. The following table lists 20 levels of positive messages in progressively levels of accomplishment.

| State | Word or Message |
|---|---|
| 1 | GO FOR IT |
| 2 | OKAY |
| 3 | ALL RIGHT |
| 4 | GOOD JOB |
| 5 | KUDOS |
| 6 | MARVELOUS |
| 7 | EXCELLENT |
| 8 | AMAZING |
| 9 | FABULOUS |
| 10 | FANTASTIC |
| 11 | INCREDIBLE |
| 12 | PHENOMENAL |
| 13 | SENSATIONAL |
| 14 | SPECTACULAR |
| 15 | AWESOME |
| 16 | SUPERB |
| 17 | SUPERIOR |
| 18 | UNBELIEVABLE |
| 19 | DID IT |
| 20 | CELEBRATE |

Optionally, state machine 24 could be configured to contain a plurality of programmable registers, each containing a different word or phrase and each corresponding to a progressively higher transition state. Using this implementation, watch 10 could be specifically tailored to better suit a particular program, e.g. using words of positive reinforcement which specifically address the benefits of refraining from a specific behavior.

Multi-character alpha display 17 is here an LCD display containing at least twelve sixteen-segment individual character displays and a background light to illuminate the display responsive to the display light enable output on function button decoder 27. The twelve individual displays are necessary to display the phrases in the table above. As mentioned previously, the display could be embodied in a number of different ways, including a single large dot matrix array. Obviously, the type of display will dictate the decoder logic of state machine and decoder module 24, unless the decoder were to be incorporated into display 18 itself or provided as a separate module or component. A primary consideration making any of these modifications is the physical size limitation of watch body 11.

An alarm 34 is provided to generate an audible signal in response to a transition signal out of state machine 24 or the alarm enable of watch module 20. The output for the transition out signal of state machine 24 and the alarm enable output of watch module 20 are ORed together to form an alarm enable input for alarm signal generator 33. Alarm signal generator 33 supplies specified frequency signals of specified duration to alarm 34, which is here a miniature piezo-electric device. This configuration assumes that the audible signals for both the alarm watch function and the state transition alarm will be identical. If different audible signals are desired for each function, the two separate enable signals can be processed independently.

Alarm signal generator 33 can be as simple as a two astable multivibrators in connection with a mono-stable multivibrator. For example, if the desired audible alarm signal were four consecutive half-second beeps, each beep separated from the other by a half-second pause, the mono-stable multivibrator would generate an activation pulse of a three and one-half second duration. This would serve as an enable pulse for the first astable multivibrator which would be configured to continuously produce half-second pulses separated by half-second pauses as long as the first astable multivibrator is enabled. These pulses would then serve as the enable for the second astable multivibrator which is configured to produce a continuous stream of pulses at an audible frequency while it is enabled. Obviously, more complex audible signals can be generated in a similar way and there are other ways of producing the alarm signal.

In use, the user wears wristwatch 10 as he or she would any other wristwatch. However, when the user decides to quit a particular habit, he or she will depress abstinence start/reset button 14 twice in rapid succession. This will then activate abstinence failure reset module 25 resulting in both count-up display 17 and alpha display 18 being reset to their original states. Counter module 22 will begin counting elapsed time which is displayed on display 17 and positive messages are then displayed on display 18. If the user should happen to falter, he or she must again depress abstinence start/reset button 14 twice in rapid succession to begin the process again.

While there is shown and described the present preferred embodiment of the invention, it is to be distinctly understood that this invention is not limited thereto but may be variously embodied to practice within the scope of the following claims.

I claim:

1. A behavior modification aid which comprises:

a wristwatch including a watch band and a watch body having an octagon shaped perimeter and being red in color and having the word STOP thereon to resemble a stop sign;

a first display means for displaying the time of day being fixed on the watch body;

a count-up display means for displaying elapsed time in terms of at least days being fixed on the watch body;

an electronic circuit for measuring the time of day being operably attached to the first display means to display the time of day thereon;

count-up counter means being operably attached to the circuit for counting elapsed time from a selected point in time;

the counter means further being operably attached to the count-up display means to display the time elapsed since the selected point in time; and reset means being operably attached to the count-up counter means for resetting the elapsed time to zero and resetting the selected point in time a multi-character alpha display means being fixed to the watch body for displaying words of positive reinforcement; and means for generating words of positive reinforcement responsive to elapsed periods of time.

2. The behavior modification aid of claim 1 further comprising:

a multi-character alpha display means being fixed to the watch body for displaying words of positive reinforcement; and means for generating words of positive reinforcement responsive to elapsed periods of time.

3. The behavior modification aid of claim 2 wherein the means for generating words of positive reinforcement comprises:

a state machine being operably attached to the counter means and the multi-character alpha display means for generating words of positive reinforcement in response to preset intervals of elapsed time; and the state machine being configured so each successive state represents a higher level of accomplishment.

* * * * *